US009145625B2

(12) United States Patent
Zhang et al.

(10) Patent No.: US 9,145,625 B2
(45) Date of Patent: Sep. 29, 2015

(54) CARD WIRE WITH IMPROVED TOOTH SHAPE

(75) Inventors: Yuning Zhang, Ghent (BE); Philip Furnier, Deerlijk (BE); Piet Vanacker, Beveren-Leie (BE); Laurent Peries, Lys lez Lannoy (FR)

(73) Assignee: GROZ-BECKERT KG, Albstadt (DE)

( * ) Notice: Subject to any disclaimer, the term of this patent is extended or adjusted under 35 U.S.C. 154(b) by 0 days.

(21) Appl. No.: 14/344,224

(22) PCT Filed: Sep. 7, 2012

(86) PCT No.: PCT/EP2012/067522

§ 371 (c)(1),
(2), (4) Date: Mar. 11, 2014

(87) PCT Pub. No.: WO2013/037711

PCT Pub. Date: Mar. 21, 2013

(65) Prior Publication Data

US 2014/0338154 A1 Nov. 20, 2014

(30) Foreign Application Priority Data

Sep. 15, 2011 (EP) ..... 11181393

(51) Int. Cl.
*D01G 15/88* (2006.01)

(52) U.S. Cl.
CPC ..... *D01G 15/88* (2013.01)

(58) Field of Classification Search
CPC ..... D01G 15/84; D01G 15/88
USPC ..... 19/114; D15/78
See application file for complete search history.

(56) References Cited

U.S. PATENT DOCUMENTS

| | | | | |
|---|---|---|---|---|
| 2,937,413 | A * | 5/1960 | Hollingsworth | 19/114 |
| 4,651,387 | A * | 3/1987 | Giuliani | 19/113 |
| 5,581,848 | A * | 12/1996 | Egerer | 19/114 |
| 6,408,487 | B1 | 6/2002 | Atkinson | |
| 7,818,848 | B2 * | 10/2010 | Maerz | 19/114 |
| 8,590,110 | B2 * | 11/2013 | Iten et al. | 19/114 |
| 8,745,826 | B2 * | 6/2014 | Vangheluwe et al. | 19/114 |
| 8,789,244 | B2 * | 7/2014 | Vangheluwe et al. | 19/114 |
| 2004/0128800 | A1 * | 7/2004 | Graf | 19/114 |
| 2012/0255143 | A1 * | 10/2012 | Iten et al. | 19/106 R |
| 2013/0042437 | A1 * | 2/2013 | Vangheluwe et al. | 19/114 |

FOREIGN PATENT DOCUMENTS

| | | | |
|---|---|---|---|
| JP | 1306625 | A | 12/1989 |
| WO | 00/26450 | A1 | 5/2000 |

OTHER PUBLICATIONS

International Search Report for PCT/EP2012/067522, dated Jan. 3, 2013.

* cited by examiner

*Primary Examiner* — Shaun R Hurley
(74) *Attorney, Agent, or Firm* — Bacon & Thomas, PLLC

(57) ABSTRACT

A card wire comprises an elongated rib portion and teeth. The teeth have a front portion and a back portion. The teeth hang over towards their front portion. The front portion and back portion merge at the tip of the tooth. The front portion comprises at least three sections: a first section extends from the tip of the tooth in the direction of the rib portion, a second section extends below the first section in the direction of the rib portion and a third section extends from the end of the second section in the direction of the rib portion. The second section comprises a straight part and a curved segment, wherein the straight part has a minimum length of 0.10 mm and the straight part has an angle between 10 and 30 degrees relative to the length direction of the card wire.

15 Claims, 4 Drawing Sheets

CARD WIRE WITH IMPROVED TOOTH SHAPE

BACKGROUND OF THE INVENTION

The invention relates to card wires (or carding wires). The card wires have an improved tooth shape. The front of the tooth is designed in order to have excellent fiber retention properties combined with good strength and fatigue resistance of the teeth. The card wires can e.g. be used on doffers on cards for short fiber spinning (so called revolving flat cards as used in e.g. cotton fiber spinning) and on workers, doffers and condensers on roller cards as e.g. used in nonwoven industry.

BACKGROUND

WO00/026450 describes a card wire that essentially entails the concept that enhanced fiber transfer efficiency can be achieved by forming one or more undercuts on the forward or inside face of the overhanging teeth of carding wire. The or each undercut preferably includes a portion substantially parallel to the longitudinal direction of the wire, i.e. the peripheral surface of the cylindrical structure on which the wire is wrapped. WO 00/026450 discloses card wires that have a straight portion in the undercut, straight portion that is substantially parallel to the longitudinal direction of the card wire (e.g. in FIG. 3 of WO 00/026450). Although such wires have excellent fiber transfer and fiber retention characteristics, there are limitations in the number of points per square inch that can be obtained with such card wire when wound on a roller of a card, essentially because low pitches between teeth cannot be reached without undue loss of tooth strength and fatigue resistance of the teeth. The relevant strength and fatigue resistance are the resistance of the teeth against the load by the fibers onto the teeth of the card wire due to the carding action.

SUMMARY OF THE INVENTION

It is an objective of the present invention to provide card wires with excellent fiber retention and excellent transfer efficiency; and that have superior strength and fatigue resistance over the prior art. It is another objective of the present invention to provide card wires with a low pitch between the teeth and that have excellent fiber retention, with superior strength and fatigue. A low pitch between the teeth allows the development of a card wire with a high number of points per square inch (ppsi) once wound on a roller of a carding machine.

Still today, the way to express the number of points (tips) per unit of surface area in carding industry is in points per square inch (ppsi). The amount of points per unit of surface area can easily be converted to number of points per square millimeter by dividing by 645.16 (which is 25.4*25.4).

A first aspect of the invention is a card wire. The card wire comprises an elongated rib portion and teeth. The teeth are having a front and a back portion. The teeth are hanging over towards their front portion. The front and back portion are merging at the tip of the tooth. The front portion comprises at least three sections. A first section extends from the tip of the tooth in the direction of the rib portion. A second section extends below the first section in the direction of the rib portion. The second section comprises a straight part and a curved segment. This straight part is having a minimum length of 0.10 mm and the straight part is having an angle between 10 and 30 degrees relative to the length direction of the card wire. The straight part is followed in the direction of the rib portion by the curved segment wherein the curved segment is having a radius of at least 0.18 mm. The front portion comprises a third section from the end of the second section in the direction of the rib portion.

The combination of the features in the second section creates strength and fatigue resistance of the card wire. In order to have sufficient straight portion (required for fiber retention), the minimum angle of the straight portion is required.

A minimum value for the length of the straight part creates constant conditions of frictional resistance for the fibers along this straight part of the second section of the front portion of the wire, leading to efficient fiber retention properties.

Preferably, the straight part has a length of at least 0.15 mm and more preferably at least 0.25 mm. Longer length of the straight part results in higher fiber retention of the card wire. Straight part lengths of higher than 0.25 mm are especially beneficial, as a considerable amount of fibers can be effectively held at such lengths of straight parts.

Preferably the straight part in the second section is having an angle between 10 and 20 degrees relative to the length of the card wire, resulting in excellent fiber retention.

Another preferred range for the angle that the straight part of the second section is making with respect to the length of the card wire is between 15 and 20 degrees. This range is resulting in a good fiber retention, while still allowing some fiber recycling when using the card wire on a doffer roller, amount of recycling at a level that can be beneficial for web quality.

Preferably the curved segment is having a radius of maximum 0.50 mm. Preferably the radius is at least 0.20 mm. Preferably however, the radius is lower than 0.25 mm as a high value for the radius limits the dimension of the straight part of the second section which would result in less potential to retain fibers.

The dimensions of the card wire can easily be measured using modern microscopic techniques, e.g. with computer aided measurement techniques or by use of a projection microscope.

A benefit of the invention is that the second section can be put closer to the tip of the card wire compared to the undercut of wires in WO 00/026450 that have in the undercut a straight portion that is substantially parallel to the longitudinal direction of the card wire. A second section that is higher positioned (i.e. closer to the tip) is beneficial for the amount of fibers that the card wire can take and hold.

In an embodiment of the invention, the first section of the card wire comprises a straight line downwards from the tip over at least half of the length of the first section to the start of the second section. The benefit of this embodiment is a still stronger card wire. Especially the tip section is reinforced and up to the part of the card wire with the second section. Preferably, the first section comprises a straight line downwards from the tip over at least three quarters of the length of the first section to the start of the second section. More preferably, the first section comprises a straight line downwards from the tip over substantially the full length of the first section and to the start of the second section. With substantially is meant here within the production tolerances. Another benefit of this embodiment is that the tooling to make the card wire is less complex and will have a longer lifetime in production, in punching the card wire.

In an embodiment of the invention the card wire has a substantially flat tip section. The substantially flat tip section has an angle with the length direction of the card wire between −5 and 20 degrees, preferably between −5 and 5 degrees, and more preferably between 0 and 5 degrees, and wherein the substantially flat tip section has a length of at least 0.1 mm (meaning that the tip section is substantially flat over a length of at least 0.1 mm). With a positive angle of the tip section with the length direction is meant that from the tip away to the back of the tooth along the substantially flat tip section, the substantially flat tip section is declining towards the bottom of the tooth. With substantially flat tip section is meant that the tip section is flat within manufacturing tolerances. The characterizing features of this embodiment strengthen in a synergetic way the benefits of the card wire of the invention.

In an embodiment of the invention, the included tip angle is between 15 and 60 degrees, and preferably between 15 and 40 degrees, and more preferably between 25 and 35 degrees. With included tip angle is meant the angle included between the two tangent lines at the tip of the tooth: on the one hand the tangent at the tip towards the front of the tooth and on the other hand the tangent at the tip towards the back of the tooth. The characterizing features of this embodiment improve the benefits of the card wire even further.

In an embodiment of the invention, the first section comprises two substantially straight lines, a first straight line from the tip downwards and a second substantially straight line downwards from the first straight line. Preferably the two substantially straight lines are connected by means of a curved segment. With a substantially straight line is meant straight within manufacturing tolerances. The angle of the second straight line with the length direction of the card wire is between 2 and 60 degrees, preferably between 5 and 30 degrees, more preferably between 5 and 20 degrees, larger than the angle of the first straight line with the length direction of the card wire. Card wires according to this embodiment show further improved performance. A good initial penetration of the tip of the card wire into the fiber tufts contributes to the good carding performance of the card wire while having a good strength of the card wire.

In an embodiment, the curved segment is a segment with a central angle between 50 and 65 degrees. It is an advantage of this embodiment that the design of the front of the tooth can be such to ensure that under the straight part a larger amount of fibers can be stored. Preferably, the central angle is between 55 and 65 degrees. A central angle is an angle whose vertex is the centre of a circle, and whose sides pass through a pair of points on the circle, thereby subtending an arc between those two points whose angle is (by definition) equal to the central angle itself. It is also known as the arc segment's angular distance.

In an embodiment the card wire according to the invention comprises a third section that starts with a straight line and that is followed by a curved connection towards the rib portion. Preferably, this straight line has an angle between 60 and 75° degrees with the length direction of the card wire.

Alternatively, the section that follows the curved section in the direction of the rib portion can be curved.

Preferably, the tooth pitch is be between 1.7 and 5 mm. With tooth pitch is meant the distance along the length of the card wire between two consecutive teeth. More preferably, the tooth pitch is between 1.7 and 2.3 mm, even more preferably the tooth pitch is between 1.7 and 2 mm. As the invention enables to make card wires that have good fiber retention but with lower tooth pitch, a card wire according to the invention can be made with a higher number of points per square inch (once mounted on the roller on the card) while maintaining tooth strength and fatigue resistance. For a number of carding applications, it is important to have a high number of points per square inch on the mounted card roller to ensure the quality of the carded fiber web. An example is on doffers on short staple revolving flat cards and on doffers on nonwoven cards which process fine fibers for the production of light webs.

According to an embodiment of the invention, a card wire is provided wherein the point density is higher than 350 points per square inch. With the point density in ppsi (points per square inch) is meant the number of points per inch over the length of the card wire, divided by the rib thickness (the thickness of the rib portion) expressed in inch, this is also the point density once the card wire is mounted on a card roller. More preferably, the density of the card wire is higher than 380 points per square inch. The point density of a card wire is defined by the tooth pitch (distance between two teeth in length direction of the card wire) and the rib thickness of the card wire. Card wires according to the invention can be made with smaller tooth pitches than the wires described in WO00/026450 because of the enhanced tooth strength and fatigue resistance. And hence card wires with a higher number of points per square inch can be made available that still have good tooth strength and fatigue resistance. Even if prior art card wires such as described in WO00/026450 have high fiber retention, the regularity of a fiber web is improved when using card wires according to the invention and that have a density higher than 350 points per square inch, and even more with card wires according to the invention that have a density higher than 380 points per square inch. On the one hand the wires according to the invention allow some fiber recycling on the card resulting in better fiber blending and the high amount of points per square inch means that less fibers are controlled per tooth, the combined synergetic effect leads to improved web quality.

In an embodiment, a card wire is provided wherein the front portion is comprising downwards towards the rib portion of the second section at least one additional second section. With at least one additional second section is meant a section that is comprising a straight part, which is having an angle between 10 and 30 degrees relative to the length of the card wire, and the straight part is followed by a curved segment with a radius of at least 0.18 mm. With such wires, fibers can be controlled at multiple heights at the front portion of the card wire, resulting in improved fiber control, while having a card wire with excellent tooth strength and fatigue resistance.

In an embodiment, the card wire has along its back portion downwards after the tip and before the spaced segment, a minimum value of the angle between the back portion and the length direction of the card wire that is higher than 30 degrees. With the angle between the back portion and the length direction of the card wire is to be understood the angle—at a particular point of the back portion—of the tangent to the back portion, relative to the length direction of the card wire. The minimum value of the angle is the lowest of these angles over the complete back portion. The term "spaced segment" refers to the spacing between a pair of teeth and in particular the spaced segment refers to the base portion of the teeth wherein the front portion of one teeth and back portion of adjacent teeth converges towards the rib portion.

With the tip is meant where the point of the tooth is shaped and specifically the connection between the front portion and the back portion at the point of the tooth.

Towards the back portion, the tip has a particular shape, e.g. cut point, full aquiline, semi aquiline, double back angle, flat land or rounded. It is preferred for the invention that at the front portion the tip has a straight line. Even more preferred, this straight line is the start of the first section. Wear of the card wire on the card will round off the front part of the tip.

Preferably, the minimum value of the angle between the back portion and the length direction of the card wire is higher than 35 degrees, more preferably higher than 40 degrees, even more preferably higher than 45 degrees and even still more preferably higher than 50 degrees.

It is a benefit of this embodiment that slender teeth are obtained. This means that in between the teeth, more space is available to accommodate fibers. Fibers can more easily enter the space between the front of a tooth and the back of the previous tooth. This is of particular interest when tooth pitches are smaller, as with smaller tooth pitches, a risk exists that insufficient space is available between back and front of teeth to accommodate fibers. If teeth are less slender, the penetration of the teeth into the fibers (to collect and retain fibers) is more difficult as well.

In an embodiment of the invention, the card wire comprises a convex segment at the back portion located at the same height (meaning similar height relative to the tip of the card wire) as the second section of the front portion. This convex segment is along the length of the back portion followed by a concave segment, wherein the convex and concave segments are located from the tip downwards before the spaced segment. The concave and convex segment are along the back portion of the tooth of the card wire. It is obvious that a card wire has a concave section in the spaced segment (the interconnection between two teeth), but this concave section is not to be understood as the concave section along the back portion of the tooth of the card wire of this embodiment of the invention. The convex segment at the back portion located at the same height as the second section of the front portion creates additional tooth material in length direction between front and back portion of the tooth at the location of the second section of the front portion.

The presence of the additional tooth material results in card wire teeth that are even more resistant to the (dynamic) (fiber) load on the teeth during use of the card wire. The wire has a higher strength and superior fatigue resistance, which is important in operating conditions with high load on the teeth.

In an embodiment, the card wire has a convex segment at the back portion located at the same height as the second section of the front portion and the convex segment is along the length of the back portion preceded by a concave segment and followed by a concave segment, wherein the convex and the concave segments are located from the tip downwards before the spaced segment. This embodiment combines enhanced tooth strength with good penetration of the teeth into fibers for effective carding.

In an embodiment, the card wire has striations on one or on both sides of the teeth. Preferably, striations are located at the same height as the straight part of the second section. The presence of striations enhances the fiber retention potential of the card wire in a synergetic way.

According to an embodiment a card wire is provided that is created by a punching operation. Preferably, the first section, the second section and the third section are created by one single punching operation.

A second aspect of the invention is a condenser roller of a nonwoven card. The condenser roller is clothed with a card wire as described in the first aspect of the invention. A card wire according to the invention can be advantageously used on condenser rollers on nonwoven cards with long lifetime of the wires and good web quality without fiber loading on the condenser rollers that occurs if card wires have a too high fiber retention.

Use of the card wire that has in addition a convex segment at the back portion located at the same height as the second section of the front portion and wherein the convex segment is along the length of the back portion is followed by a concave segment is especially interesting on condenser rollers on nonwoven cards. Due to the specific mode of operation of the condenser rollers of a nonwoven card, the convex segment is creating an additional fiber retention element but allowing timely fiber release, working in synergy with the front part of the card wire according to the invention, resulting in improved web regularity.

A third aspect of the invention is a doffer roller of a revolving flat card clothed with a card wire as described in the first aspect of the invention. Card wires according to the invention are interesting for use on revolving flat cards. Revolving flat cards are e.g. used for carding short staple fibers in the short staple spinning process. Major application segment is carding of cotton fibers, but also man-made and synthetic fibers such as polyester, rayonne (viscose) . . . are carded with revolving flat cards when intended to be spun into short staple yarns. The combination of the properties of the card wire according to the invention results in high strength and fatigue resistance, higher number of points per square inch that is possible and excellent fiber retention values. The high strength and fatigue resistance is especially of interest in cotton carding where trash can be present in the cotton resulting in an enhanced load on the card wires, including on the doffer wires. The higher ppsi that is possible (e.g. card wire according to the invention and that has more than 330 ppsi, preferably more than 350 ppsi, even more preferably more than 380 ppsi and even more preferably more than 400 ppsi) is in synergy with the high values of fiber retention (but that is still allowing a certain amount of fiber recycling to allow fiber blending) responsible for the high quality of sliver on revolving flat cards. The high quality is in terms of a low number of neps and a low CV (coefficient of variation) of the card sliver.

A doffer and/or worker roller of a roller card can also beneficially be equipped with a card wire according to the first aspect of the invention.

DETAILED DESCRIPTION OF THE INVENTION

Figure 1A:
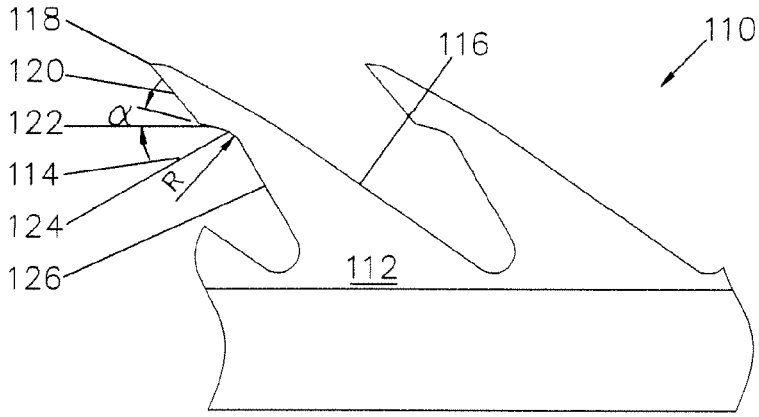
FIGS. 1, 2 and 3 show in lateral view different embodiments of card wires according to the invention.
Figure 1B:
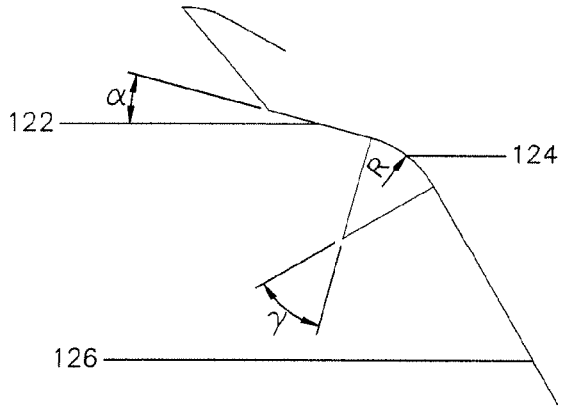

FIG. 1 (FIG. 1*a* and FIG. 1*b*) shows an example of a card wire 110 according to the invention. The wire comprises a rib portion 112 and a plurality of teeth over the length of rib portion 112. The teeth are having a front portion 114 and a back portion 116. The front portion 114 and the back portion 116 can be created by a punching operation out of a profiled wire made e.g. in rolling starting from a round wire. The teeth are hanging over to the front portion. The front portion 114 and the back portion 116 are merging at the tip 118 of the tooth. The tip 118 has a full aquiline shape. The front portion comprises at least three sections. A first section 120 extends from the tip of the tooth in the direction of the rib portion. The first section 120 of FIG. 1 shows an embodiment where the first section is a straight line downwards from the tip over substantially the full length of the first section to the start of the second section. A second section extends below the first section in the direction of the rib portion 112. The second section comprises a straight part 122 and a curved segment 124 which has radius R. The straight part is making an angle alpha (α) with the length direction of the card wire. In the embodiment in FIG. 1, the front portion 114 is formed by the first section 120, the second section and by the third section 126. In a preferred embodiment the curved segment has a central angle gamma (γ, see FIG. 1*b*) of between 45 and 65 degrees.

In a specific example, the angle of the first section to the length direction of the card wire is preferably 45 to 60 degrees, for instance 50 degrees. In the example, the straight part of the second section starts at a vertical distance of 0.76 mm from the tip of the card wire. With vertical distance is meant the distance measured perpendicularly to the length direction of the card wire. The straight part has a length of 0.2 mm and an angle of 12 degrees with respect of the length direction of the card wire. The radius of the curved segment of the second section is 12 degrees and the central angle is 48 degrees. Preferably, the angle of the straight part of the third section is between 50 and 70 degrees with respect of the length direction of the card wire, e.g. 60 degrees. The minimum back angle of the card wire (with respect to the length of the card wire is preferably within the range of 25 to 50 degrees (and more preferably 30 to 45 degrees), for instance 35 degrees. With minimum back angle is meant the lowest value of the angle between the back portion of the card wire and the length direction of the card wire. The pitch of the card wire given in this example is 2.50 mm. In another example, the pitch of an otherwise similar card wire is 2.0 mm. Examples of these card wires according to the invention are with rib thickness 0.8 mm, of 0.9 mm, of 1 mm, of 1.6 mm, of 1.27 mm and of 1.59 mm.

In other embodiments of the invention, the front portion can comprise other sections or other segments besides the first section, second section and third section.

Figure 2:
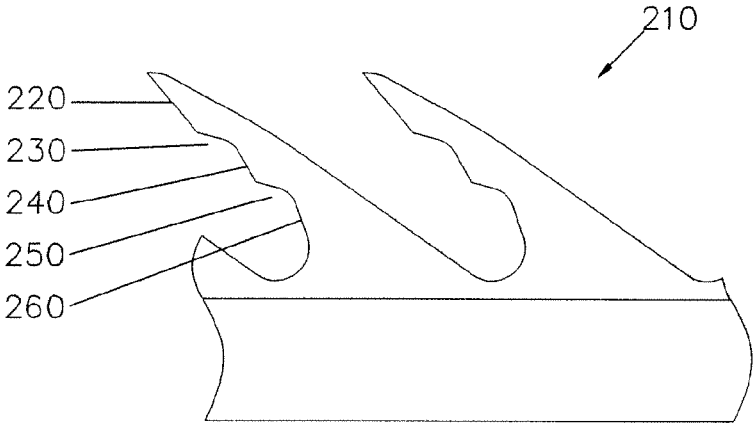

In other embodiments of the invention, the front portion comprises more than one second section, each second section is comprising a straight part and a curved segment, wherein the straight part is having a minimum length of 0.10 mm and the straight part is having an angle between 10 and 30 degrees relative to the length direction of the card wire, and the straight part is followed by a curved segment wherein the curved segment is having a radius of at least 0.18 mm. FIG. 2 shows such a card wire 210 with a first section 220, a first second section 230, an intermediate segment 240, a second second section 250 and a third section 260. In this example, the first section 220, the first second section 230, the intermediate segment 240, the second second section 250 and the third section 260 form the front portion of the tooth. Both second segments 230 and 250 comprise a straight part and a curved segment.

Figure 3:
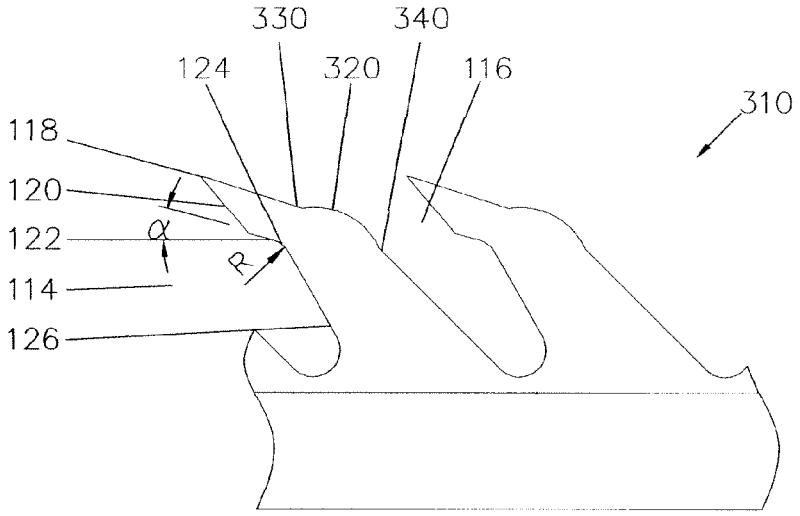

FIG. 3 shows another example of a card wire according to an embodiment of the invention. The teeth 310 of the card wire are having a front portion 114 and a back portion 116. The front portion 114 and the back portion 116 are merging at the tip 118 of the tooth. The tip 118 is full aquiline. The front portion 114 comprises at least three sections. A first section 120 extends from the tip of the tooth in the direction of the rib portion. A second section extends below the first section in the direction of the rib portion 112. The second section comprises a straight part 122 and a curved segment 124 which has radius R. The straight part is making an angle alpha (α) with the length direction of the card wire. The card wire further comprises a convex segment 320 at the back portion 116 of the wire, whereby the convex segment 320 is located at the same height (meaning similar height relative to the tip of the card wire) as the second section of the front portion 114 and wherein the convex segment 320 is along the length of the back portion 116 preceded by a concave segment 330 and followed by a concave segment 340.

Figure 4:
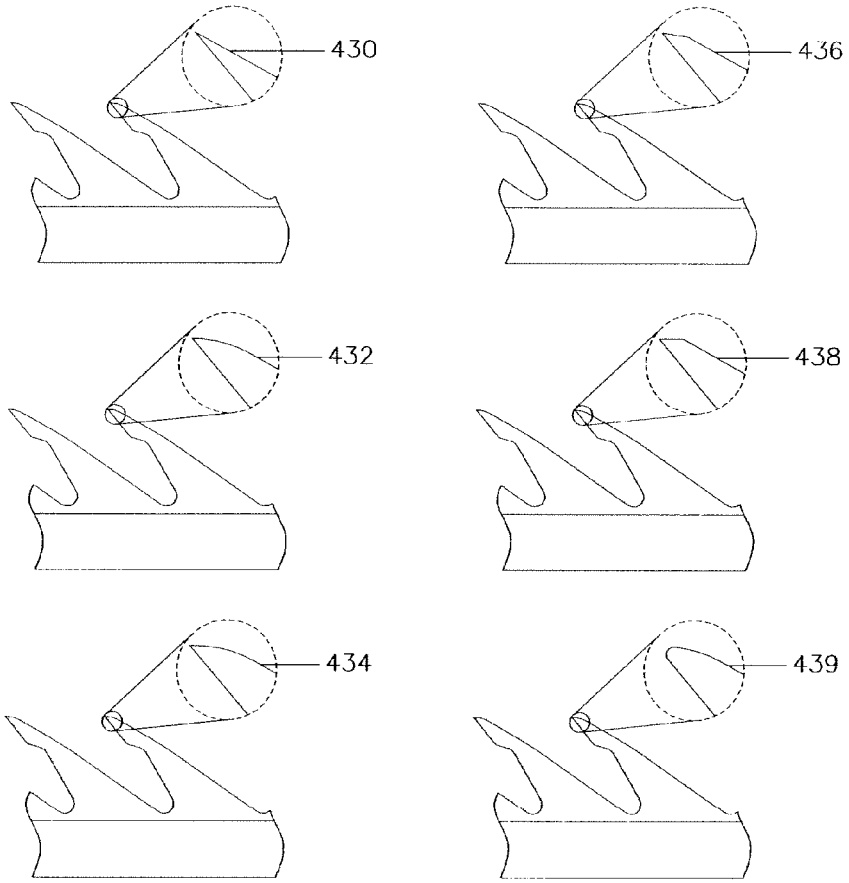
FIG. 4 shows embodiments of tip shapes.

FIG. 4 depicts a number of different possible shapes of the tips for the teeth of the present invention. In one embodiment of the present invention the shape of the tip is cut point 430 (with cut point is meant that the tip is essentially created by the intersection of two straight line, one from the front portion and one from the back portion of the card wire). In another embodiment of the present invention the shape of the tip is semi aquiline 432 (with semi aquiline is meant that in the tip towards the back there is a curved line with a tangent that is parallel with the length of the card wire). In yet another embodiment of the present invention the shape of the tip is full aquiline 434 (with full aquiline is meant that in the tip towards the back there is a curved line with a tangent that is below a line that is parallel with the length of the card wire). In yet another embodiment of the present invention the shape of the tip is double back angle 436. In yet another embodiment of the present invention the shape of the tip is flat land 438. In yet another embodiment of the present invention the shape of the tip is rounded 439.

The term "striations" refers to a number of tiny parallel grooves/veins along the longitudinal direction of the wire profile. Such a profile is preferably manufactured at the height of a or the second section of the front portion of the teeth. In an embodiment of the present invention the teeth of the wire profile comprise striations along the longitudinal direction of the wire profile. In another embodiment of the present invention the striations are positioned at the height of the second section. In yet another embodiment of the present invention the striations are in form of grooves and veins occurring in alternative forms along either side of the wire profile to increase fiber retention capabilities.

Figure 5:
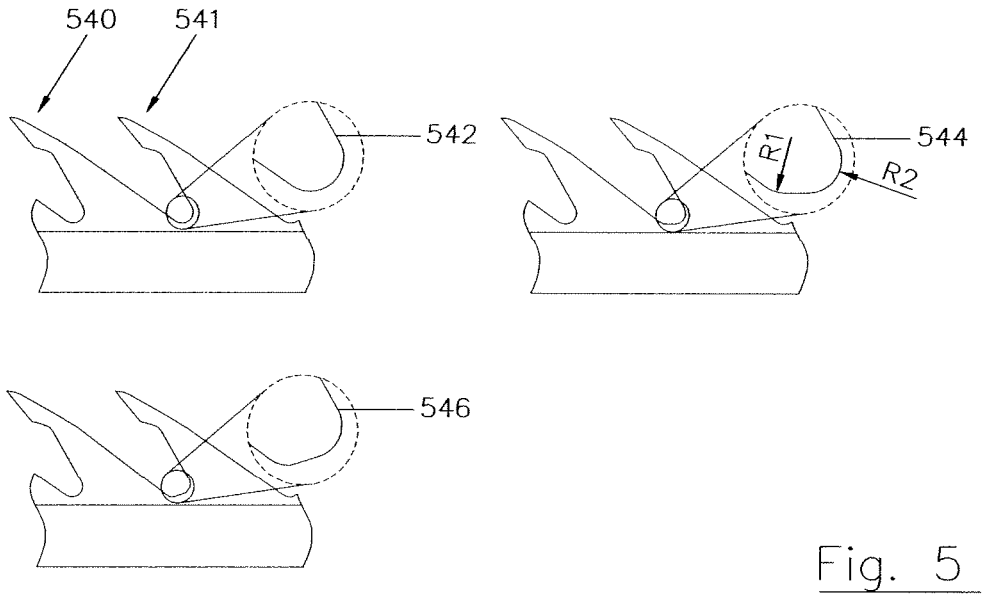
FIG. 5 shows embodiments of spaced segments between a pair of teeth.

The term "spaced segment" refers to the spacing between a pair of teeth and in particular the spaced segment refers to the base portion of the teeth wherein the front portion of one teeth and back portion of adjacent teeth converges towards the rib portion. FIG. 5 depicts different spaced segments of the present invention. In one embodiment of the present invention, the distance between the points of confluence of back portion to the rib portion of first teeth 540 to the point of confluence of front portion to the rib portion of second teeth 541 which is immediately adjacent to the first teeth is defined as the "spaced segment". In one embodiment of the present invention the spaced segment is radial curved 542. In yet another embodiment of the present invention the spaced segment is radial curved at the points of confluence with radius R1 and R2 and portion between the said points of confluence is flat bottom 544. In yet another embodiment of the present invention the spaced segment is radial curved at the points of confluence and portion between the points of confluence is inclined at an acute angle 546.

Figure 6:
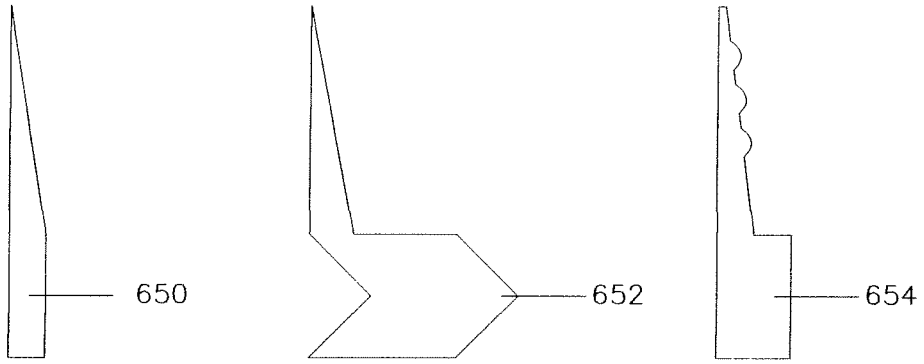
FIG. 6 shows an embodiment of wire profile in axial sectional view.

FIG. 6 depicts different shapes of the rib portion of the wire profile of the present invention. In one embodiment of the present invention the shape of the rib is rectangular to form a wedge shaped card wire 650. In another embodiment of the present invention the shape of the rib is v-interlocking 652. In yet another embodiment of the present invention the shape of the rib is rectangular to form an L-shaped wire 654.

Figure 7:
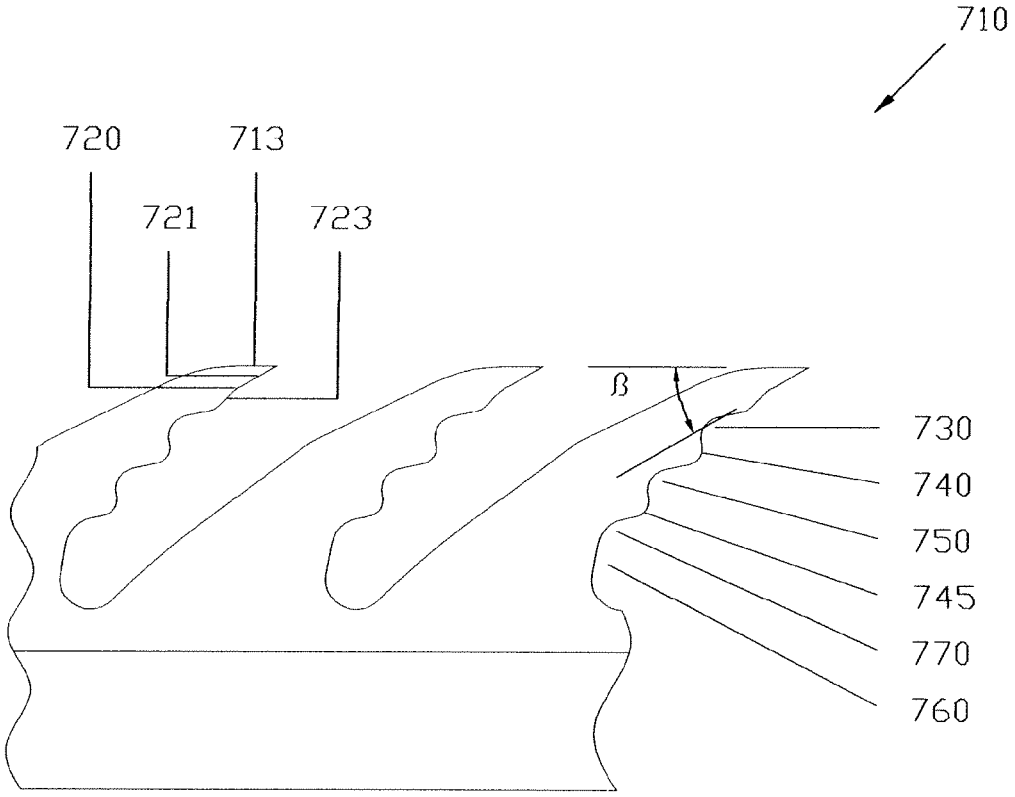
FIG. 7 shows an example of a card wire according to a specific embodiment of the invention.

FIG. 7 shows an example of a card wire 710 according to an embodiment of the invention. The card wire has a substantially flat tip section 713 that has an angle of the substantially flat tip section 713 with the length direction of the card wire of 0 degree. The flat tip section 713 is parallel with the length direction of the card wire. The substantially flat tip section 713 has a length of 0.55 mm (in an alternative embodiment, this tip section can be curved instead of substantially flat). The card wire has an included tip angle β (beta) of 30 degrees.

The first section 720 of the front portion of the card wire tooth comprises two substantially straight lines, a first straight line 721 from said tip downwards makes an angle of 30 degrees with the length direction of the card wire. A second substantially straight line 723 downwards from said first straight line makes an angle of 45 degrees with the length direction of the card wire. Consequently, the difference between the angles of both straight lines with the length direction is 15 degrees in the example shown in FIG. 7. In the example, the front portion of the tooth comprises three second sections—such wires with one or with two second sections are covered by the invention as well. Each second section is comprising a straight part and a curved segment, wherein the straight part is having a minimum length of 0.10 mm and the straight part is having an angle between 10 and 30 degrees relative to the length direction of the card wire, and the straight part is followed by a curved segment wherein the curved segment is having a radius of at least 0.18 mm.

The card wire of FIG. 7 shows such a card wire 710 with a first second section 730, an intermediate segment 740, a second second section 750, another intermediate segment 745, a third second section 770 and a third section 760.

A wire profile of the present invention can be made as follows. Starting product is a wire rod (usual diameters e.g. 1.20 mm or 7.0 mm) with a steel composition along the following lines: carbon content ranging from 0.30% to 2.0%, e.g. from 0.5 to 1.2%; e.g. from 0.6 to 1.1%; silicon content ranging from 0.10% to 2.5%, e.g. from 0.15 to 1.60%; manganese content ranging from 0.10% to 2.0%, e.g. from 0.50 to 0.90%; chromium content ranging from 0.0% to 2.0%, e.g. from 0.10% to 1.50%; e.g. from 0.10% to 0.90%; vanadium content ranging from 0.0% to 2.0%, e.g. from 0.05% to 0.60%, e.g. from 0.10% to 0.50%; tungsten content ranging from 0.0% to 1.5%, e.g. from 0.1% to 0.70%. In one embodiment of the present invention, the composition of wire profile may contain either chromium or vanadium. In some other compositions both chromium and vanadium are present. The amounts of sulfur and phosphorous are preferably kept as low as possible, e.g. both below 0.05%, e.g. below 0.025%.

The wire rod is cold and dry drawn until the desired non-round profile is reached. Rolling can be carried out by means of Turks heads or by means of rolls. Drawing can be done by means of profile drawing dies. The profile depends upon the application can be square, rectangular, or take an L-form. The basis leg of the L forms the rib portion and the top leg of the L will house the eventual teeth. After this profiling, the teeth are formed in the profile wire by means of a cutting operation preferably a punching operation. The forming of the teeth may be followed by a deburring operation.

Thereafter the formed saw toothed wire profile is subjected to some heat treatments, which aim at stress-relieving the rib portion of the saw-toothed wire and at hardening the teeth. Therefore, the entire saw toothed wire is heated until a temperature of about 600° C. and the teeth get an additional heating until they reach a temperature of about 900° C. Thereafter the entire wire is quenched so that the foot is stress relieved and the teeth are hardened since the teeth are subjected to a much greater jump in temperature. The global heating until 600° C. can be done by means of induction heating or by means of a gas burner. The heating of the teeth until 900° C. can be done by means of an additional gas burner, or by passing the teeth through a plasma arc or torch. The quenching operation can be done in an oil bath or in a bath of polymers.

The performance of the card wire can be verified via the visual observation of the web regularity and of the number of neps present in the web. In the case that slivers or slubbing are formed at the exit of the cards (that will be further processed in short staple or long staple yarn spinning), the sliver or slubbing can be tested on the number of neps, the distribution of the fiber length and the regularity and number of defects of the sliver. In the case of cotton slivers, the AFIS (Uster's Advanced Fiber Information System) test device is a well known device used for testing sliver parameters such as number of neps, trash particles and fiber length and fiber length distribution. In the case of spun yarns, the yarn can be tested on a regularity tester and the number of neps, number of thin places and the number of thick places can be determined to assess quality of the yarn.

The invention claimed is:

1. A card wire comprising an elongated rib portion and teeth said teeth are having a front portion and a back portion, said teeth are hanging over towards their front portion, said front portion and said back portion are merging at the tip of the tooth, said front portion comprises at least three sections, a first section extends from the tip of the tooth in the direction of the rib portion, a second section extends below the first section in the direction of the rib portion, said second section comprises a straight part and a curved segment, said straight part is having a minimum length of 0.10 mm and said straight part is having an angle between 10 and 30 degrees relative to the length direction of the card wire, and said straight part is followed in the direction of the rib portion by said curved segment wherein said curved segment is having a radius of at least 0.18 mm, and said front portion comprises a third section from the end of said second section in the direction of the rib portion.

2. A card wire as in claim 1, wherein said first section comprises a straight line downwards from the tip over at least half of the length of said first section to the start of the second section.

3. A card wire as in claim 1, wherein the teeth have an included tip angle, wherein the included tip angle is between 15 and 60 degrees.

4. A card wire as in claim 1, wherein the card wire has a substantially flat tip section, wherein the substantially flat section has an angle with the length direction of the card wire, wherein the angle of the substantially flat tip section with the length direction of the card wire is between −5 and 20 degrees and wherein the substantially flat tip section has a length of at least 0.1 mm.

5. A card wire as in claim 1, wherein said first section comprises two substantially straight lines, a first straight line from said tip downwards and a second substantially straight line downwards from said first straight line and wherein the angle of the second straight line with the length direction of the card wire is between 2 and 60 degrees larger than the angle of the first straight line with the length direction of the card wire.

6. A card wire as in claim 1, wherein said curved segment is a segment with a central angle between 50 and 65 degrees.

7. A card wire as in claim 1, wherein the third section starts with a straight line and is followed by a curved connection towards the rib.

8. A card wire as in claim 1, wherein the card wire has a tooth pitch, wherein the tooth pitch is between 1.7 mm and 2 mm.

9. A card wire as in claim 1, wherein the card wire has a point density, wherein the point density is higher than 350 points per square inch.

10. A card wire as in claim 1, wherein the front portion is comprising downwards towards the rib portion of said second section at least one additional of said second section.

11. A card wire as in claim 1, wherein, along said back portion downwards after the tip and before the spaced segment, the minimum value of the angle between said back portion and the length direction of the card wire is higher than 30 degrees.

12. A card wire as in claim 1, wherein the card wire comprises a convex segment at the back portion located at the same height as said second section of the front portion and wherein said convex segment is along the length of the back portion followed by a concave segment, wherein said convex segment and said concave segment are located from the tip downwards before the spaced segment.

13. A card wire as in claim 1, wherein the card wire comprises a convex segment at the back portion located at the same height as said second section of the front portion and wherein said convex segment is along the length of the back portion preceded by a concave segment and followed by a concave segment, wherein said convex segment and said concave segments are located from the tip downwards before the spaced segment.

14. A card wire according to claim 1, wherein the card wire has striations on one or on both sides of the teeth.

15. A condenser roller of a nonwoven card or a doffer roller of a revolving flat card, wherein the roller is clothed with a card wire as described in claim 1.

* * * * *